United States Patent [19]

Day

[11] Patent Number: 4,548,222

[45] Date of Patent: Oct. 22, 1985

[54] FULL-AUTOMATIC UMBRELLA

[76] Inventor: San-Tong Day, 1 Chung Yang North Rd., Ching Shui, Taichung Hsien, Taiwan

[21] Appl. No.: 577,820

[22] Filed: Feb. 7, 1984

[51] Int. Cl.[4] ..... A45B 25/14

[52] U.S. Cl. ..... 135/24; 135/20 R

[58] Field of Search ..... 135/22, 23, 24

[56] References Cited

U.S. PATENT DOCUMENTS

| | | | |
|---|---|---|---|
| 3,658,076 | 4/1972 | Yasuda | 135/24 |
| 3,672,381 | 6/1972 | Kida et al. | 135/22 |
| 3,756,258 | 9/1973 | Yoshihara | 135/22 |
| 3,856,030 | 12/1974 | Sato | 135/22 |
| 4,421,133 | 12/1983 | Huang | 135/22 |

*Primary Examiner*—Robert A. Hafer
*Assistant Examiner*—Daniel Nolan
*Attorney, Agent, or Firm*—Burns, Doane, Swecker & Mathis

[57] ABSTRACT

A full-automatic umbrella operable single-handedly by means of a single control device is provided with a tube having a handle at the lower end thereof, an outer tubular shaft mounted on the upper end of said tube and provided with an intermediate ring at the top thereof, an upper inner shaft inserted in the upper end of said outer tubular shaft and provided with an upper ring at the top thereof, a sliding member mounted over said outer tubular shaft and provided with a lower ring at the upper end thereof, a rib assembly collapsibly and pivotably connected to said upper, intermediate and lower rings, a control device disposed in said stick and being operable to control the opening and collapsing of the umbrella through said control means, a coil spring adapted for closing the umbrella mounted in between said intermediate and lower rings, and two coil springs adapted for opening of the umbrella mounted separately in the upper and lower portions of said stick.

4 Claims, 6 Drawing Figures

FULL-AUTOMATIC UMBRELLA

DETAILED DESCRIPTION

The present invention relates to single-pushbutton-operated full automatic umbrella and, more particularly, to umbrella in which a single pushbutton can be operated single-handedly in automatically opening and extending the umbrella stick when it is in the closed position and in automatically closing and collapsing the umbrella when it is in the opened position.

Currently, an automatic umbrella belongs to either of the three following types: (1) umbrella which can be extended automatically but can not be collapsed, and which needs manual operation in closing, (2) umbrella which can be extended automatically, but needs manual operation in closing and collapsing, and (3) umbrella which can be extended and closed automatically but can not be collapsed. Prior art on automatic umbrella can readily be had from, for example, U.S. Pat. No. 3,856,030 to Sato. However, the former two types of umbrella which can be opened automatically but can not be closed likewise may be designated as semi-automatic ones while the umbrella of the last type which is automatically openable and closable can be designated as full automatic one; nevertheless, the umbrella of the last type can not be collapsed, accordingly the stick of which has to be much longer and is therefore not suitable for keeping inside a case or luggage to be carried along in travelling. Besides, the umbrella has two pushbuttons for operations of opening and closing respectively; as a result, an accidental touch of a wrong button often ends in contrary action and may cause malfunction to the umbrella components.

Thus, the present invention is aimed at providing a full automatic umbrella which can be opened and closed, but also collapsed and contracted automatically so that its length is shortened consequently to be suitable for carrying along in travelling, and in addition, which is convenient to operate.

It is a further object of the invention to provide a full automatic umbrella whereby operation of a single pushbutton with one hand enabling it to be opened and extended from its closed and collapsed condition and vice versa.

It is yet another object of the invention to provide a full automatic umbrella which is simple in construction and costs less to manufacture while being precisely operable.

It is yet an additional object of the invention to provide a full automatic umbrella in which the same control button can be operated for automatic opening or closing of the umbrella without any likelihood of malfunction caused to the components because of accidental touch of the control button.

Other aspects and advantages of the present invention will readily be appreciated as the same becomes better understood by the following detailed description of the preferred embodiment, taken in conjunction with the accompanying drawings in which.

Figure 1:
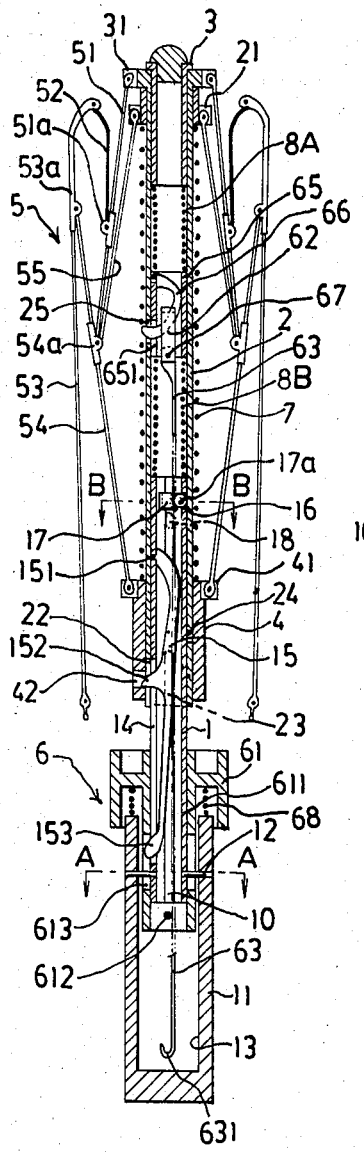
FIG. 1 shows a full automatic umbrella of the present invention in sectional elevation in the closed and collapsed position.
Figure 5:
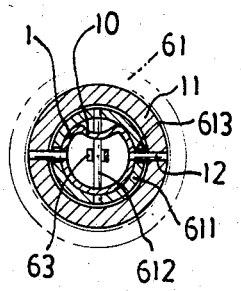
FIG. 5 is a cross-sectional view of FIG. 1 taken along the line A—A.

Referring now to FIG. 1, the full automatic umbrella of the present invention comprises: an inner tubular shaft member 1 having at one end a handle 11, an outer tubular shaft member 2 slidably and retractably mounted on the upper end of said inner shaft 1 and provided at the top an intermediate ring 21, an upper tubular shaft member 3 retractably inserted in the upper end of said outer shaft 2 and provided at the top thereof an upper ring 31, a sliding tubular member 4 slidably mounted on said outer shaft 2 and having at the upper end a lower ring 41, a rib assembly 5 having collapsible ribs couplingly and collapsibly pivoted at the upper ring 31, intermediate ring 21 and lower ring 41, a control unit 6 housed in said inner shaft 1, adapted for controlling the opening and closing of the umbrella by operating a control ring 61 provided at the upper end of the handle and a first coil spring 7 disposed between the intermediate ring 21 and the lower ring 41 and the two coil springs, second and third, 8A, 8B located in the lower inner tubular shaft 1.

Figure 6:
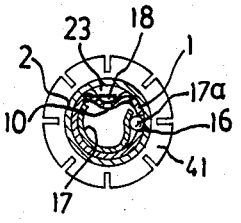
FIG. 6 is a cross-sectional view of FIG. 1 taken along the line B—B.

Aforesaid lower inner tubular shaft 1 is a metal tube having an axially extended, V-shaped guide-groove 10 formed on one side, the lower end thereof being firmly attached with the handle 11 provided with a center cavity 13 by means of 2 set pins 12, while the lower tube wall thereof being provided with an axially elongated opening 14 adapted for receipt of a spring pawl 15 one end 151 of which being fixedly attached to the upper inner wall of lower inner tubular shaft 1 while at the free end and the middle portion being formed with two locking heads 152, 153 which are retractable into the opening 14 to be kept in the lower inner shaft 1 by the resilient force of the spring pawl 15. An aperture 16 adapted for receiving a steel ball **17*a* is formed in the upper end of the shaft 1, wherein a U-shaped sheet spring 17 is welded to the inner side of the steel ball 17*a* which is being constantly pressed against the outer wall of the aperture by the spring force of said sheet spring 17. In addition, there is fixed on the upper end portion of the V-shaped guide-groove 10, as shown in FIG. 6, an engaging member 18 to prevent the lower inner tubular shaft 1 from slipping out the outer tubular shaft 2**.

The outer tubular shaft 2 is a metal tube having at the upper end an intermediate ring 21 and it lower end retractably and slidably mounted on the upper end portion of the lower inner shaft 1; relative to the elongated opening 14 formed in the lower inner shaft 1, the lower end of the side wall of the shaft 2 is provided with a notch 22 wherethrough the locking head 152 of aforesaid spring pawl 15, protrudes out to be engaged with the sliding tubular member 4, when the umbrella is in the closed position as depicted in FIG. 1. In addition, the lower end of one side of said shaft 2 in relation to the V-shaped guide-groove 10 is formed by press-molding with an inwardly projecting portion 23 to provide a means for engagement with afore-said engaging member 18 in preventing the lower inner shaft 1 from slipping out of the outer tubular shaft 2. Slightly above the notch 22 in the outer tubular shaft 2, there is defined an aperture 24 for receiving the steel ball **17*a*** of the lower inner shaft 2, thereby preventing the outer tubular shaft 2 from sliding downward. A further opening 25 is defined in one side near the middle portion of the outer shaft 2 and accommodated therein the spring pawl 66 has the upper end fixedly attached to the wall of said shaft and the free end protruding outwardly from said opening 25 to be engaged with aforesaid sliding tubular member 4.

The upper inner tubular shaft 3 has an upper ring 31 mounted on its upper end while its lower end is retractably inserted in the upper portion of the outer tubular shaft 2.

The sliding tubular member 4 is a short piece of tube having at the upper end a lower ring 41 mounted thereon and in the wall of the lower end portion relative to the notch 22 of the outer tubular shaft 2 formed with an opening 42 to be engaged with the locking head 153.

The rib assembly 5 comprises a plurality of first main ribs 51 having each one end pivotably connected to the upper ring 31 and each of the other end extending downwards, a plurality of first auxiliary ribs 52 having each one end pivotably connected to a cramp fitting 51*a* disposed in slightly to the middle of said first main ribs 51, a plurality of the second main ribs 53 having each upper end pivotably connected to each of the other end of said first auxiliary ribs 52 and the lower end being free and extending downward, a plurality of supporting ribs 54 having each one end pivotably connected to the lower ring 41 and the other end pivotably connected to the cramp fitting 53*a* disposed in close to the upper portion of said second main ribs 53, and a plurality of second auxiliary ribs 55 having each one end pivotably connected to the intermediate ring 21 and the other end pivotably connected to the cramp fitting 54*a* disposed in slightly to the middle of the supporting ribs 54 and whereto the lower end of the first main ribs also pivotably connected.

The control unit 6 comprises a control ring 61 being axially and slidably mounted on the lower end of the lower inner shaft 1 above the upper portion of the handle 11, a sleeve 65 being slidably housed in the outer tubular shaft 2 in slightly the upper portion with one side of the lower portion thereof provided with an axial slot 651, a spring pawl 66 having one end fixed to the upper end of the sleeve 65 and the free end protruding out in aforesaid axial slot 651, an actuating member 62 having a space 621 between the two side walls with the spring pawl 66 engaged therein, a pulling rod 63 being disposed in the lower inner shaft 1 and the outer tubular shaft 2 with one end thereof being connected to the lower end of the actuating member 62 by a pin 67 and the other end thereof formed with a hook end 631 to be accommodated in the center cavity 13 of the handle 11, and a return spring 68 being disposed in between the control ring 61 and the handle 11. The abovementioned control ring 61 is provided with a tubular portion 611 which is retractably inserted in the center cavity 13 of the handle 11 and which at the inner end is fixed with a pin 612 adapted to be hooked over by the hook end 631 of the pulling rod 63. In addition, in the wall of the tubular portion 611, there is defined an elongated opening 613, through the lower end of which is passed fittingly the set pin 12 which fixes the handle 11 in the lower inner shaft 1, and into which the locking head 153 of the spring pawl 15 also protrudes from the lower inner shaft 1, so that the control ring 61 can be operated axially to control the spring pawl 15 and the pulling rod 63.

Figure 3:
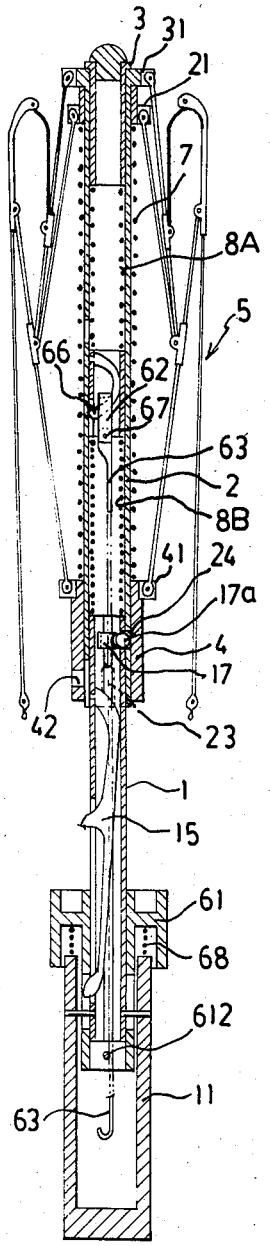
FIG. 3 shows a full automatic umbrella of the present invention in sectional elevation in the closed position.
Figures 2, 4:
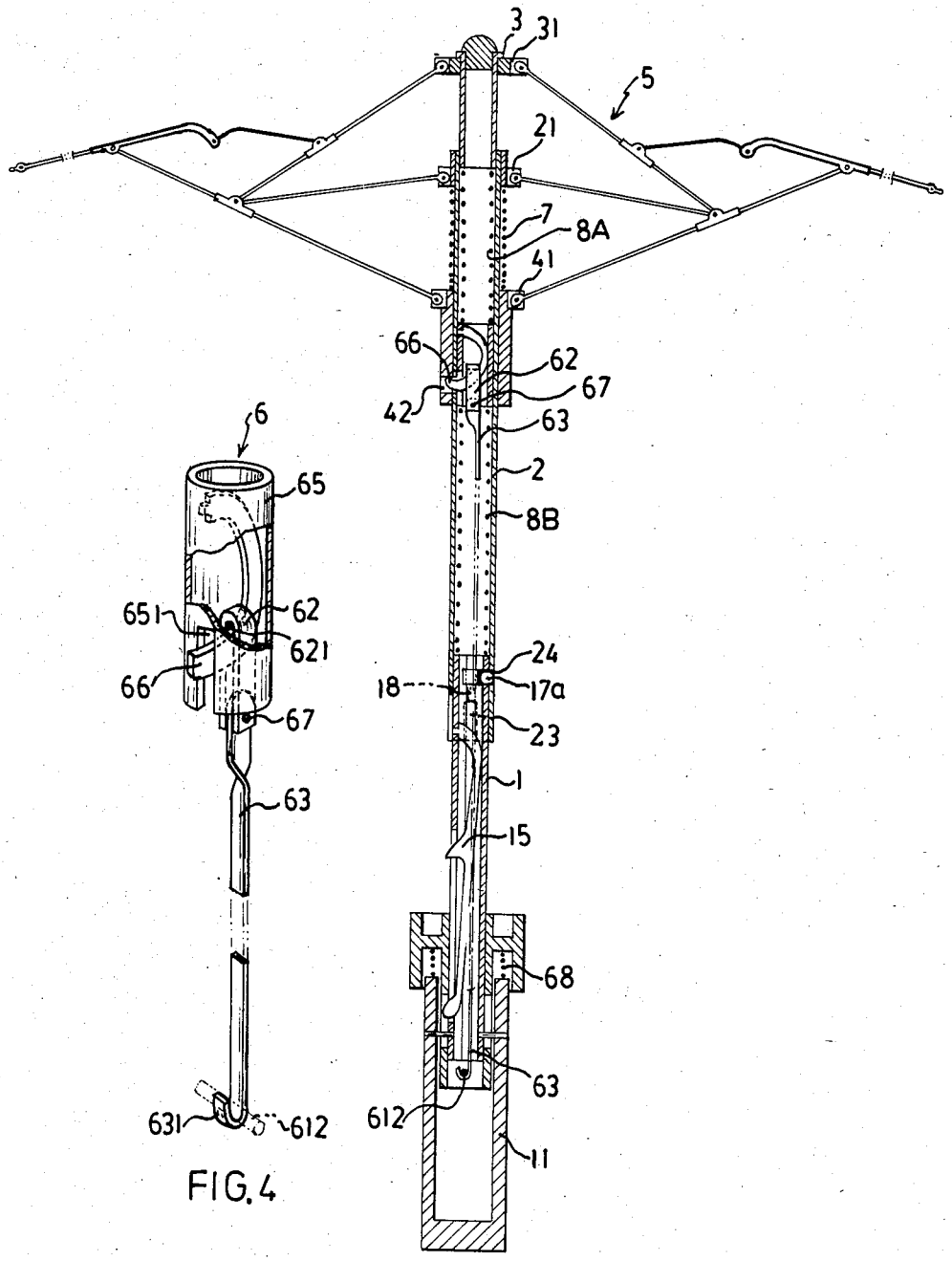
FIG. 2 illustrates a full automatic umbrella of the present invention in sectional elevation in the fully extended position.
FIG. 4 is a schematic view of the control device.

On the upper end of the outer tubular shaft 2 in between the intermediate ring 21 and lower ring 41 there is mounted a first coil spring 7 which appears to be released and freely extended when the umbrella is in the closed position as illustrated in FIGS. 1, 3, or on being compressed appears to be completely contracted when the umbrella is in the open position as depicted in FIG. 2. Provided for opening the umbrella, the second coil spring 8A of the two coil springs is arranged in between the upper end of the actuating member 62 and the lower end of the upper inner shaft 3 in the outer tubular shaft 2, while the other spring, the third coil spring 8B, is also disposed in the outer tubular shaft 2 but in between the lower end of the actuating member 62 and the upper end of the lower inner shaft 1. When the umbrella is closed as shown in FIG. 1, these two coil springs 8A, 8B appear to be in the compressed position; however, when the umbrella is opened as depicted in FIG. 2, the second coil spring 8A retains some extension force and is thus in the semi-extended position while the third coil spring 8B is in a completely extended and released position.

Next, the operation of opening and closing of the full automatic umbrella in accordance with the present invention will be described in detail as follows.

FIG. 1 shows the umbrella in a completely closed and collapsed position and the two coil springs 8A, 8B being completely compressed to be in the pre-use condition. At this time, the locking head 152 is passed through the elongated opening 14 of the shaft 1 and the notch 22 of the outer tubular shaft 2 and engaged in the opening 42 of the sliding tubular member 4 so that the latter is kept locked in the lower end of the outer tubular shaft 2. The spring pawl 66 is protruding outwardly from the axial slot 651 of the sleeve 65 and the opening 25 of the outer tubular shaft 2. Since the second and third coil springs 8A, 8B are now in compressed condition, they are therefore tending to push the upper inner shaft 3 and lower inner shaft 1 outward so as to spread out the rib assembly 5. However, the umbrella is maintained in the closed position because of the sliding member 4 being engaged with the spring pawl 15 and the rib assembly thereby remaining unspread.

In opening the umbrella, the operator is to depress the control ring 61 lightly, which by virtue of the upper edge of the elongated opening 613 forces the locking head 153 to move downward. Concurrently, the locking head 152 is moved downward too, whereby the sliding member 4 is released from engagement therewith. As a result, the upper and lower inner shafts 3, 1 are being pushed upward and downward respectively to be extending out from the two ends of the outer tubular shaft 2 under the action of the elastic forces exerted by the second and third coil springs 8A, 8B. Since the elastic force exhausted by the second coil spring 8A is greater than that by the first coil spring 7 and as the upper inner shaft 3 is extending upward, along which the sliding member 4 is thus being moved upward with respect to the outer tubular shaft 2. The intermediate ring 41 in compressing the first coil spring 7 on one hand, is, on the other hand, spreading the ribs of rib assembly 5 upward and outward by virtue of the position change thereof with respect to the upper and lower rings 31, 21 coupled with linkage motion thereof till the ribs are fully extended in the manner as shown in FIG. 2 when the first coil spring 7 is completely compressed and the opening 42 in the lower end of the sliding member 4 is being engaged with the spring pawl 66. Meanwhile, the upper end of the lower inner shaft 1 with the engaging member 18 thereof is engaged with the projecting portion 23 in the lower end of the outer tubular shaft 2 so that the former will not slip out of the latter. At the same time, due to the adaptation by which the steel ball 17*a* is engaged in the aperture 24 of the outer tubular shaft 2, the backward withdrawal thereof can be prevented when the umbrella is faced with strong wind. In this condition, the second coil spring 8A is in its semi-extended condition and retains substantial elastic energy in keeping the umbrella in the opened position, while the control ring 61 is returned to the position where the pin 612 thereof is being hooked by the hook end 631 of the pulling rod 63.

When the umbrella which has been opened is next to be closed, the operator needs only to depress the control ring 61 as shown in FIG. 2 once again, thereby releasing the spring pawl 66 from engaging with the sliding member 4 into the opening 25 by way of the actuating member 62, pulling rod 63 and the pin 612 following the movement of said control ring 61. The sliding member 4 thus released slides downward biasing the return force exhausted by the first coil spring 7 and at the same time, with the downward movement of the lower ring 41 the rib assembly 5 is closed and collapsed. When the actuating member 62 is released from the spring pawl 66 and moved downward, the second coil spring 8A which has been in semi-extended condition, is now extending downward with its elastic energy and forcing the third coil spring 8B which is comparatively weaker in elasticity into a partially compressed position from the freely unstressed one till the umbrella is completely closed and collapsed when the upper and intermediate rings 31, 21 join each other and the two coil springs 7, 8A are in free and extended state. The umbrella is then held with the tip of the upper inner shaft pressing against the ground or any wall to force the lower inner shaft 1 into the outer shaft 2 opposing the resilient forces of the coil springs 8A, 8B, till the locking head 152 of the spring pawl 15 is engaged in the opening 42 of the sliding member 4 so that the umbrella is returned to the closed position as illustrated in FIG. 1 and the elastic energy is accumulated therein to be consumed next for automatically opening and closing the umbrella through the aforesaid operation of the control ring 61.

As described above, the components of the umbrella according to the present invention, can be operated to automatically open and close the umbrella by way of a single control ring. Additionally, the construction of such components is simple and the invention can be easily reduced to practice.

Although the present invention has been described with reference to a preferred embodiment thereof, various changes and modifications can be made by those skilled in the art without departing from the scope of the present invention.

What is claimed is:

1. A fully automatic collapsible umbrella comprising:

a lower inner tubular shaft provided with a handle at a lower end portion thereof;

a first spring pawl being fixedly attached at an upper end of the lower inner tubular shaft and having a free lower end with a first locking head and an intermediate portion with a second locking head and a spring biased ball disposed inside said lower inner tubular shaft at its upper end;

an outer tubular shaft slidably mounted on the upper end portion of said lower inner tubular shaft and provided with an intermediate ring disposed at an upper end portion thereof;

a sleeve and second spring pawl disposed inside said outer tubular shaft, said second spring pawl retractably mounted inside said sleeve;

an upper inner tubular shaft mounted in the upper end portion of said outer tubular shaft and provided with an upper ring disposed at a top portion thereof;

a sliding tubular member slidably mounted on said outer tubular shaft and provided with a lower ring mounted on an upper end portion and an opening in a lower end portion thereof;

a rib assembly comprising a plurality of first main ribs, a plurality of first auxiliary ribs, a plurality of second main ribs, a plurality of second auxiliary ribs and a plurality of supporting ribs, said ribs being pivotally interconnected with said upper, lower and intermediate rings to form an umbrella frame for opening and closing thereof;

control means including a ring member and a pulling rod for controlling engagement and disengagement of said first and second spring pawls, respectively, so as to open and close the umbrella, said ring member disposed about said lower inner tubular shaft and adjacent a top end portion of said handle;

a first coil spring for closing the umbrella mounted above the upper end portion of said outer tubular shaft and between said intermediate and lower rings;

second and third coil springs for opening the umbrella disposed inside said outer tubular shaft, said second coil spring being located between a lower end of said upper inner tubular shaft and said sleeve and said third coil spring being located between said sleeve and an upper end of said lower inner tubular shaft;

said handle being provided with a cavity for receiving a lower end portion of said pulling rod;

said lower end portion of said lower inner tubular shaft provided with an elongated opening for receiving said first and second locking heads of said first spring pawl;

said outer tubular shaft being provided with a notch in a lower end for receiving said second locking head when the umbrella is closed, an aperture disposed slightly above said notch for engaging said ball when the umbrella is opened and an opening in a middle portion for engaging said second spring pawl when the umbrella is closed;

wherein, when the umbrella is closed, said second locking head of said first spring pawl is engaged in said opening of said sliding tubular member, said second spring pawl is engaged in said opening in the middle portion of said outer tubular shaft;

and, when the umbrella is opened, said second spring pawl is engaged in the opening of said sliding tubular member and said spring biased ball is engaged in the aperture of said outer tubular shaft.

2. A full automatic collapsible umbrella according to claim 1, wherein said ring member is slidably mounted on the lower end of said lower inner tubular shaft and on the top end portion of said handle; an actuating member engaging with said second spring pawl and said pulling rod disposed in said outer tubular shaft and said lower inner tubular shaft and having one end thereof being connected to the lower end of said actuating member and the other end forming a hook extending through said lower inner tubular shaft into the cavity of said handle.

3. A full automatic collapsible umbrella according to claim 1, wherein said first coil spring in the umbrella closed position is in a free and extended state and in the umbrella opened position is in a compressed state.

4. A full automatic collapsible umbrella according to claim 1, wherein said second and third coil springs in the umbrella closed position are in a compressed state and in the umbrella opened position said second coil spring is in a partially extended state and said third coil spring is in a free and extended state.

* * * * *